United States Patent [19]

Lincoln

[11] Patent Number: 4,714,378

[45] Date of Patent: Dec. 22, 1987

[54] APPARATUS AND METHOD FOR TRENCHING SUBSEA PIPELINES

[75] Inventor: John B. Lincoln, Applecross, Australia

[73] Assignee: Ocean Engineering Systems, Pty., Ltd., Applecross, Australia

[21] Appl. No.: 734,370

[22] Filed: May 15, 1985

[30] Foreign Application Priority Data

May 22, 1984 [AU] Australia ..... 28500/84

[51] Int. Cl.[4] ..... E02F 3/88; E02F 5/10; F16L 1/04

[52] U.S. Cl. ..... 405/163; 405/161; 37/62; 37/64

[58] Field of Search ..... 405/158, 159, 161–164, 405/165, 174, 180–183; 37/61–64, 78

[56] References Cited

U.S. PATENT DOCUMENTS

| | | |
|---|---|---|
| 1,028,523 | 6/1912 | Anderson . |
| 2,879,649 | 3/1959 | Elliott . |
| 3,338,059 | 8/1967 | Tittle . |
| 3,368,358 | 2/1968 | Elliott . |
| 3,429,131 | 2/1969 | Martin . |
| 3,429,132 | 2/1969 | Martin . |
| 3,434,297 | 3/1969 | Gretter et al. . |
| 3,504,504 | 4/1970 | Elliott . |
| 3,576,111 | 4/1971 | Henry, Jr. . |
| 3,583,170 | 6/1971 | DeVries . |
| 3,616,651 | 11/1971 | Chang . |
| 3,624,933 | 12/1971 | Faldi . |
| 3,670,514 | 6/1972 | Breston et al. . |
| 3,732,700 | 5/1973 | Lynch . |
| 3,732,701 | 5/1973 | Lynch . |
| 3,751,927 | 8/1973 | Perot, Jr. . |
| 3,786,642 | 1/1974 | Good et al. . |
| 3,852,972 | 12/1974 | Holberg . |
| 3,877,237 | 4/1975 | Norman . |
| 3,952,532 | 4/1976 | Spearman . |
| 3,990,377 | 11/1976 | Marquinez . |
| 4,037,422 | 7/1977 | deBoer et al. . |
| 4,041,717 | 8/1977 | Dressel et al. . |
| 4,087,981 | 5/1978 | Norman . |
| 4,117,689 | 10/1978 | Martin . |
| 4,190,382 | 2/1980 | Schmitz et al. . |
| 4,255,882 | 3/1981 | Verboom . |
| 4,295,757 | 10/1981 | Gaspar . |
| 4,395,158 | 7/1983 | Brooks . |

*Primary Examiner*—Cornelius J. Husar
*Assistant Examiner*—Nancy J. Stodola
*Attorney, Agent, or Firm*—Cushman, Darby & Cushman

[57] ABSTRACT

Apparatus and a method for progressively forming a subsea trench and for laying a pipeline in that trench are provided. The apparatus includes a towable sled for supporting the pipeline as it is being laid in a subsea trench that is being created by fluid jetting, mechanical cutting or a combination of both, using jetting and cutting devices mounted on the sled. In the preferred embodiment, the jet device proceeds the mechanical cutter on the sled and is vertically adjustably mounted so it can be raised out of the way while the mechanical cutter is in use.

7 Claims, 11 Drawing Figures

APPARATUS AND METHOD FOR TRENCHING SUBSEA PIPELINES

BACKGROUND OF THE INVENTION

This invention relates to an apparatus and a method for trenching subsea pipelines. The pipelines can be constructed out of any usual material and used to transport any usual gas, liquid or slurry. In practicing the invention, a trenching sled is pulled along the pipe and a trench is left behind, after which the trailing pipeline settles in the trench.

There are many known methods for trenching subsea pipelines including water jetting and mechanical cutting methods.

Typical jet sleds cannot trench effectively in hard bottom conditions and traditional mechanical cutter machines have not been successful in sandy soils or for pre-laid rigid pipelines. Ploughs are usually designed for a single job and are only really effective for soft soils of a consistent nature such as cohesiveless sands or soft claves.

SUMMARY OF THE INVENTION

Apparatus and a method for progressively forming a subsea trench and for laying a pipeline in that trench are provided. The apparatus includes a towable sled for supporting the pipeline as it is being laid in a subsea trench that is being created by fluid jetting, mechanical cutting or a combination of both, using jetting and cutting devices mounted on the sled. In the preferred embodiment, the jet device proceeds the mechanical cutter on the sled and is vertically adjustably mounted so it can be raised out of the way while the mechanical cutter is in use.

The main advantage of this system is that because of its unique design features it can trench subsea pipelines by both a water jet method and a mechanical cutting method. It is therefore very versatile and for a pipeline that crosses both hard rock and loose sands the trenching can be done with one apparatus.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
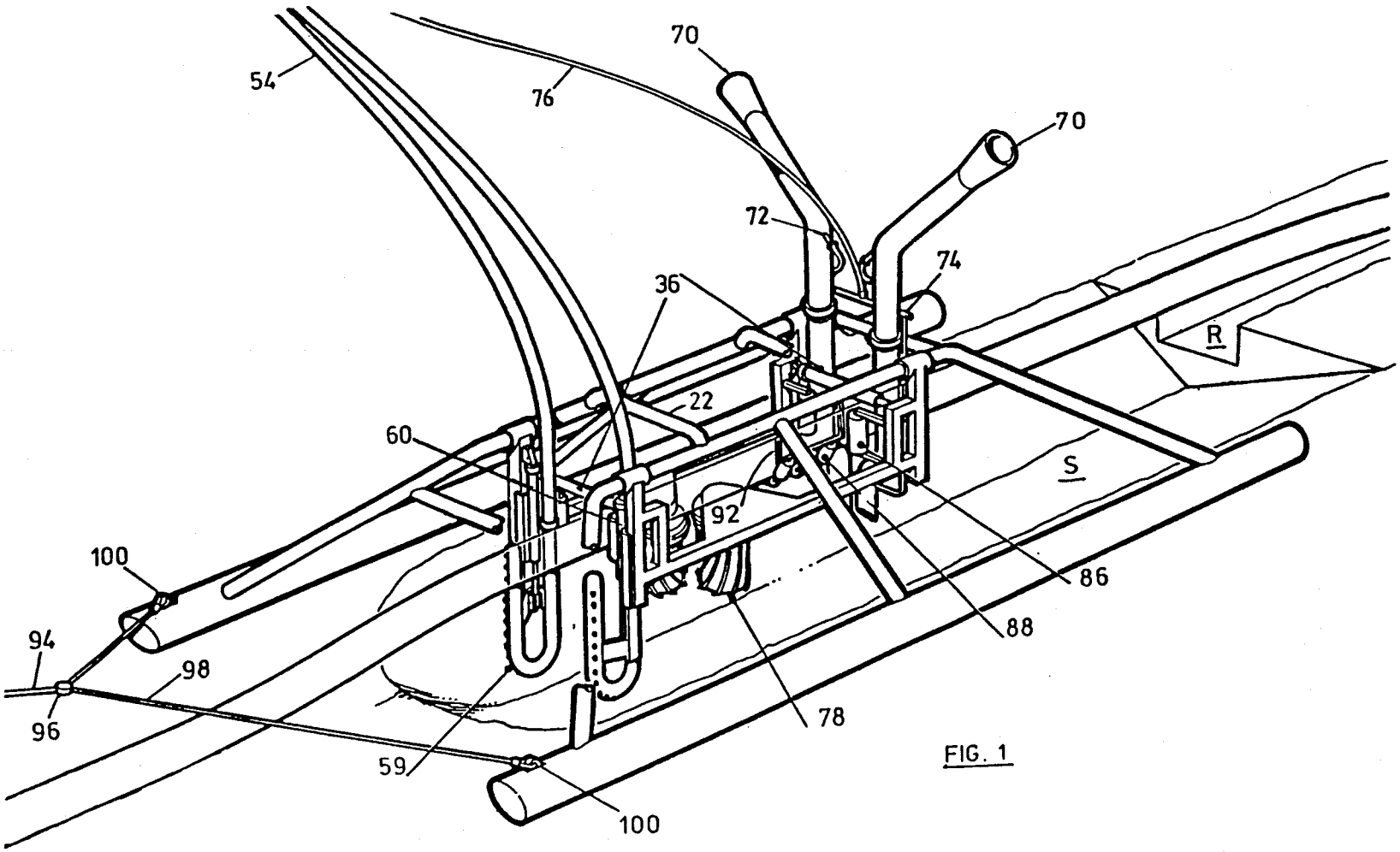
FIG. 1 is a perspective view of a subsea pipeline trenching machine embodying principles of the present invention, shown being towed along the subsea bottom, e.g. by a floating vessel (not depicted)
Figure 4:
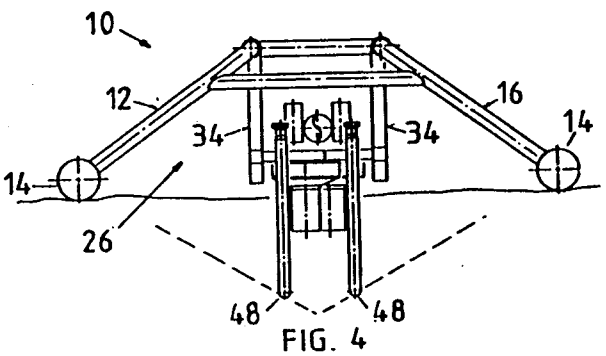
FIG. 4 is a front elevational view thereof.
Figure 2:
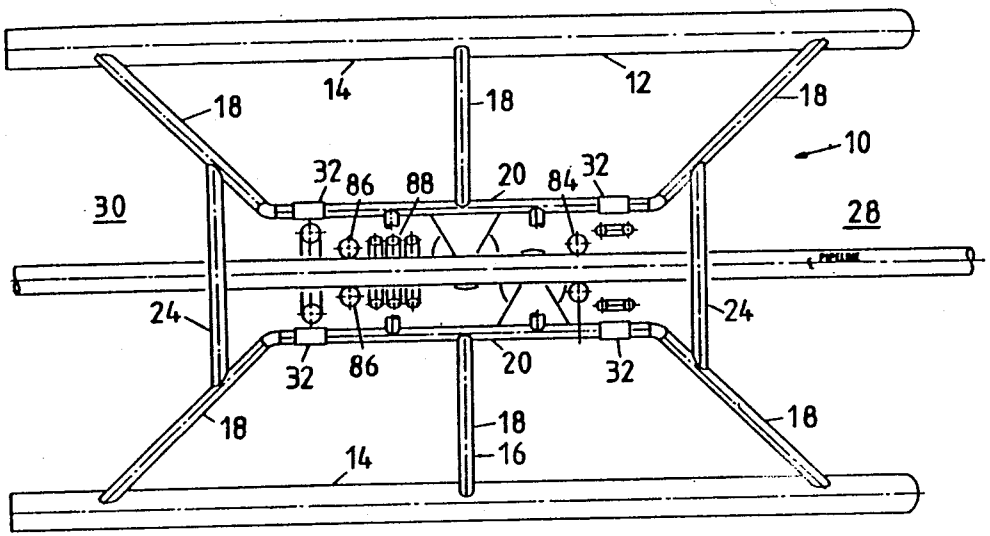
FIG. 2 is a top plan view thereof.
Figure 3:
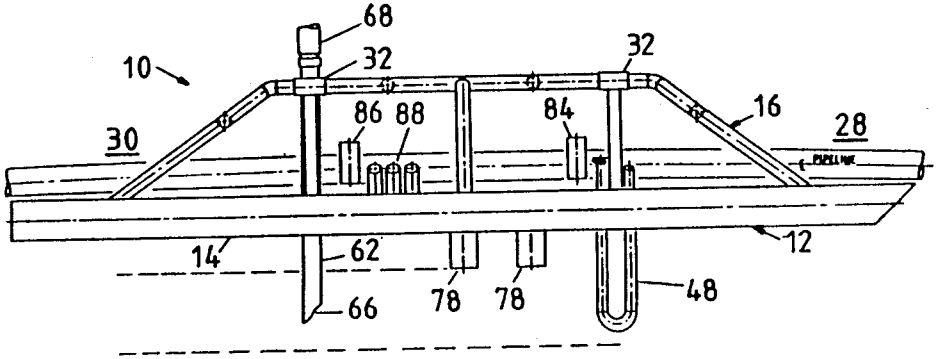
FIG. 3 is a side elevational view thereof.
Figure 7:
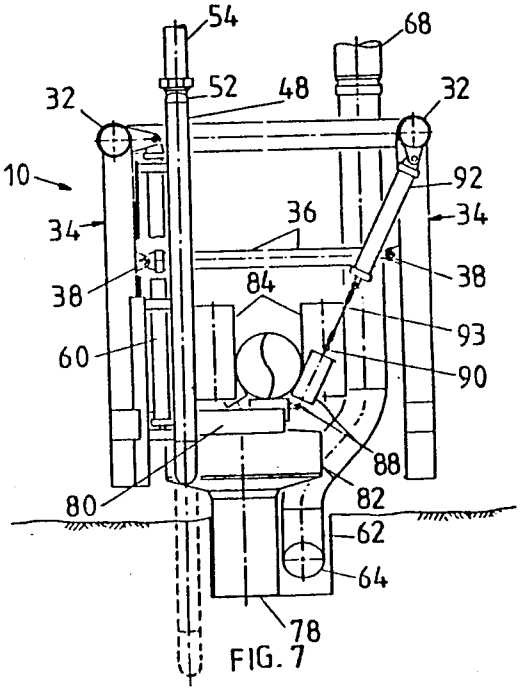
FIG. 7 is a transverse vertical sectional view thereof taken on line 7—7 of FIG. 5.
Figure 5:
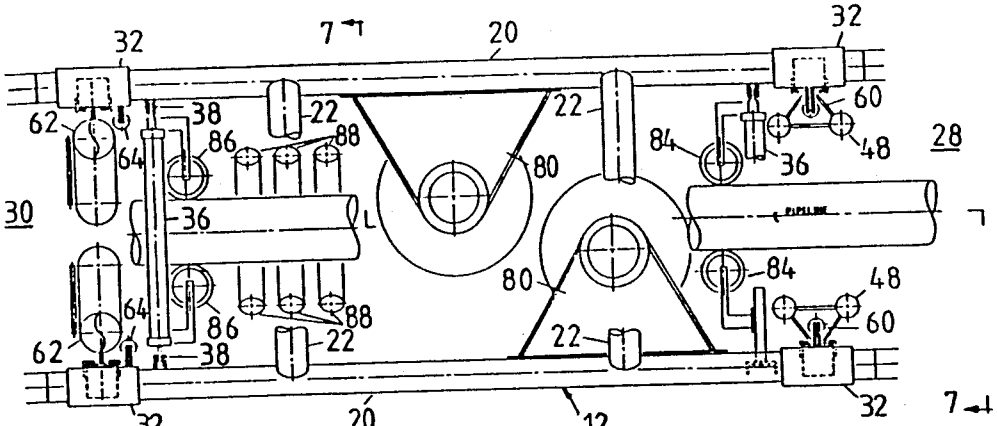
FIG. 5 is an enlarged scale fragmentary top plan view thereof.
Figure 6:
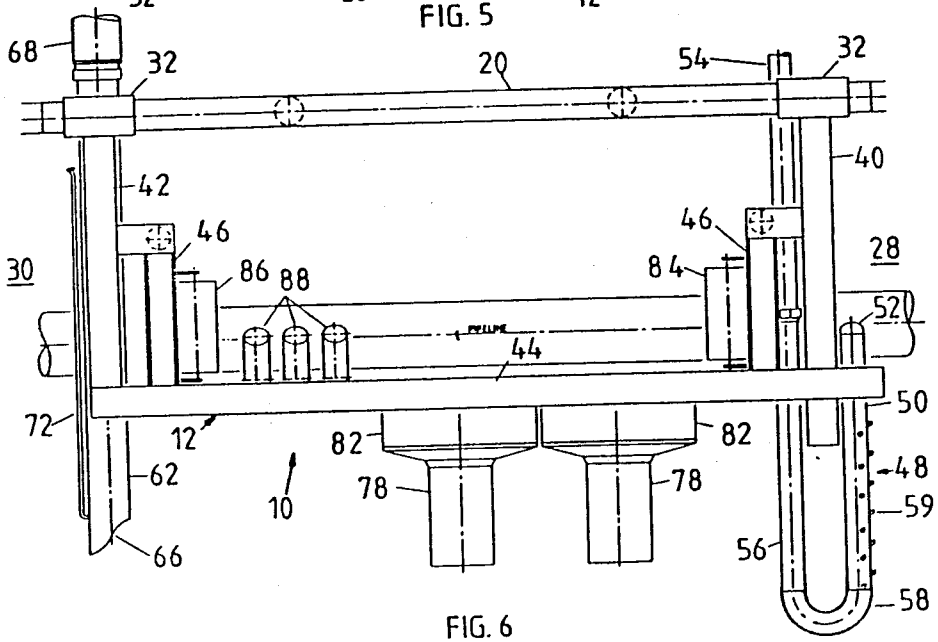
FIG. 6 is an enlarged scale fragmentary side elevational view thereof.

The unique subsea pipeline trenching apparatus was developed by the present inventor especially for use in connection with typical Australian hard seabed conditions, to trench both in hard limestone and in sandy soil. The inventor brought to the task experience gained not only off the coast of Australia, but also in the Gulf of Mexico and in the North Sea. The equipment and method of the invention are believed to be especially useful in any region where the seabed is partly rocky and partly sandy, silty or the like. The method may be applied to subsea trenching of pipe of practically any diameter, such as steel pipeline used for oil and gas collection and transport, and for concrete outfalls.

The apparatus 10 of the invention is shown including a sled 12 comprising a pair of laterally spaced, longitudinally extending pontoons 14 rigidly interconnected by a frame 16 including legs 18, longitudinal members 20, transverse members 22 and cross-braces 24. In effect, the frame 16 arches between the pontoons 14 creating a longitudinal tunnel 26 which is open towards the front at 28, towards the rear at 30, and downwards.

The inventor presently conceives of one version of the apparatus for use in relatively shallow waters, and another version for use in relatively deep waters, one-hundred meters deep being approximately the dividing line indicating use of one version or the other. In principal, the two versions share very much in common, the principal difference being that in most instances the shallow water version would be towed by a surface vessel, but the deep water version would be self-propelled on crawler tracks. Below approximately sixty meters, a preferred air lift system for spoils preferably is replaced by a water eduction system. Also on the deep water version at least some of the equipment which on the shallow water version preferably is mounted on the towing vessel and communicated via lines and/or hoses to the equipment on the sled, is, instead, mounted on the sled although it is preferred that even the deep water version be attended by a surface vessel.

Because the two versions share so much in common, the shallow water version is shown in the drawings hereof and is described in more detail herein, with some important differences for the deep water version simply being alluded to, in order to simplify the disclosure.

Mounted to the two externally cylindrical longitudinal members 20 of the frame 16 by tubular sleeves 32 are respective auxiliary frames 34. These auxiliary frames are interconnected below their sleeves 32 by transversally extending hydraulically operated, extensible-retractable piston/cylinder assemblies 36 which are capable of being operated to shift the auxiliary frames 34 from depending substantially vertically, in a working position as shown, to being rotated up and away from one another until each is adjacent the respective set of oblique legs 18 of the main frame 16. The assemblies 36, at their opposite ends are pivotally secured to the auxiliary frames at 38 to facilitate such movement. Mechanical latching means, not shown in detail, may be used for maintaining the auxiliary frames 34 in the lowered and raised positions, if desired, so that the hydraulic system need not be relied upon to hold the auxiliary frames in the respective positions for indefinitely long periods of time.

Each auxiliary frame 34 is seen as having forward and aft radial members 40, 42 connected at respective one ends to the sleeves 32, and a longitudinal member 44 connected to the radial members 40, 42 of the respective auxiliary frame at corresponding sites near the opposite ends of those radial members. A boxed corner 46 is provided at each intersection of a radial member 40 or 42 and a longitudinal member 44, both for strength and to facilitate the attachment of other structures.

At the front, a pair of jet manifolds 48 is mounted, one each, to the two auxiliary frames 34. The jet manifolds 48 are shown each comprising a generally U-shaped tube having the upper end of its forward leg 50 capped at 52, and a pressurized water supply line 54 connected to the upper end of its aft leg 56. The forward leg 50 and part of the turn 58 are provided with a vertically extending series of pressurized water outlet nozzles, i.e. water jet nozzles 59, which are constructed and arranged to fluidize a particulate subsea bottom forwardly of and under the sled 12, in a path which is straddled by the pontoons 14, as shown in FIG. 1.

At each side of the front of the tunnel 26, the respective jet manifold 48 is secured to the respective auxiliary frame by a respective hydraulic extensible-retractable piston and cylinder arrangement 60, which is parallel to the respective radial member 40, so that when the auxiliary frames are in their depending positions, the piston and cylinder arrangements 60 are oriented to move the jet manifolds 48 vertically so that they project downwards below the pontoons 14 to a greater or lesser extent, as needed.

At each side of the rear of the tunnel 26, a respective eductor tube 62 is secured to the respective auxiliary frame by a respective hydraulic extensible-retractable piston and cylinder arrangement 64, which is parallel to the respective radial member 42, so that when the auxiliary frames are in their depending positions, the piston and cylinder arrangements 64 are oriented to move the eductor tubes 62 vertically so that their open lower ends 66 are located at a level below the pontoons 14 to a greater or lesser extent, as needed.

When the eductor tubes 62 are used as part of an air lift system, tubular extensions 68 are connected to their upper ends. These angle upwardly and outwardly and have open upper ends 70. Somewhere along the tubes 62 or their extensions 68, a high pressure air line 72 is communicated to the bore so that within the bore it opens towards downstream, i.e. upwardly. The air lines 72 are shown connected by a manifold 74 to a high pressure air supply line 76 leading to the surface. Accordingly, when the device is in use in relatively shallow water, i.e. to a depth of about 60 meters, as air is supplied by the line 76 to the air lines 72 the air bubbles out into the bores of the tubes 62/68 with a considerable upward velocity, causing a "vacuum cleaner" effect, by means of which a mixture of water and loosened particulate sea bottom material is sucked in through the open lower end, rises and is blown out of the upper ends at 70. Eventually, the removed sea-bottom material settles, after the respective part of the pipeline has been laid in the respective part of the trench.

Intermediate the longitudinal extents of the auxiliary frames, two mechanical cutters 78 are mounted, one to each auxiliary frame, so that when the auxiliary frames are in their respective depending positions, the two cutters 78 are located in a staggered relation one behind the other and one centered to the left and the other to the right of the longitudinal axis of the apparatus, but each on a respective vertical axis located near the longitudinal axis of the apparatus. The cantilevering structures which mount the mechanical cutters 78 to the auxiliary frames and journal the cutters for rotation about their own longitudinal axes are shown at 80. Motors for powering the cutters 78 are shown at 82.

The apparatus 10 is shown further including fore and aft sets of left and right pipe guide rollers 84, 84 and 86, 86, rotatably mounted to the auxiliary frames at the box corners, for rotation about respective vertical axes and in rolling engagement with the pipeline being trenched.

Further, the apparatus 10 is shown including a longitudinally extending series of transversally extending sets of three urethane-covered pipe support rollers forming a cradle 88 for hangingly supporting the pipeline being trenched, in the tunnel 26 of the frame 16. At transversally opposite ends, the tension axles 90 of the cradle roller sets 88 are attached e.g. at 93 to the longitudinal members 20 of the frame 16 intermediate the location of the mechanical cutters and the eductor tubes, e.g. by means of jacking supports 92. The axles 90 are constructed and arranged to be detachably secured at respective one ends, so that the support cradle can be pushed into place under the pipeline and secured to the frame at the beginning of trenching operations using the apparatus.

When the device 10 is being used in waters less than being about 100 meters deep, it preferably is towed by a surface vessel (not shown), rather than self-propelled.

In such a case, the surface vessel, may, for instance be an off-shore supply vessel, a work barge, an anchor-handling vessel or the like. When such a vessel used, it may carry on board and/or house the required pumps, air compressors, shallow water diving equipment, control equipment, supply line reeling and tending equipment and the like for operating and serving the apparatus 10. Typically (and conventionally), a pattern of moorings would be established along the expected trenching path and the surface vessel would be tethered to two or more of these moorings by winchable cables. In order to traverse the predetermined path, the surface vessel then winches itself towards a mooring lying ahead, while correspondingly paying-out its cable connected with a mooring lying astern. (The surface vessel may employ a four-point mooring system that connects to surface buoys anchored by clump weights to the sea floor. Two additional buoys ahead of the system and a small surface vessel for connecting mooring lines allows the system to advance 1000 meters without relocation of anchors. In a 24 hour workday, the apparatus 10 is capable of trenching as much as 2.5–5 kilometers of pipeline.) Typically a tow chain hangs in a catenary from the bow of the surface vessel down to a connection with the front of the sled. As shown, the towing cable 94 wyes at 96 and its resulting two branches 98 respectively connect to fittings 100 on the tops of the pontoons 14 near the front ends of those pontoons.

Thus the apparatus 10 is constructed and arranged to be pulled forwards along the pipe trenching path as the surface vessel winches itself forwards on its mooring pattern.

Variable ballasting of the sled pontoons and varying of tow chain weight for different water depths are preferably employed as ways and means for keeping the sled near the stern of the surface vessel and maintaining the vertical pull on the sled within acceptable limits.

Typical pull loads may range between 4 and 12 tonnes. Typical submerged weight may be increased from two tonnes, to four tonnes by flooding the pontoons 14.

When the apparatus 10 is to be used, it is lowered over the pipeline lying on the sea bottom, with the auxiliary frames raised outward and upward, until the pontoons 14 are resting on the bottom and the frame 16 straddles that region, with the pipeline extending through the tunnel 26. Next, e.g. with the assistance of divers, the pipeline cradle 88 is inserted under the pipeline and its axles 90 are connected to the jacking supports 92. Next, the jacking supports 92 are raised, thereby elevating the pipeline within the tunnel 26 somewhat (e.g. 610 mm) above the seabed. Fore and aft of the apparatus 10, the elevated pipeline gradually droops down onto the seabed. (By "droops", it is meant that the pipeline gradually slopes down from the site where it is supported in an elevated condition by the cradle 88, under the apparatus 10, to where it is supported by the seabed some distance to the front of and to the rear of the apparatus 10. Because the support at 88 is a cantilevering support for the pipeline, to the extent that the pipeline is flexible, the fore and aft segments of the pipeline, i.e. between the cradle 88 and the seabed respectively to the front and to the rear of the apparatus 10 can be expected to have a very gentle "S" curvature, as seen in side elevation.)

Next the auxiliary frames 34, (which together with supported structures constitute a pipeline enclosure frame) are closed about the thus-elevated section of pipeline by contraction of the respective transversally extending piston and cylinder arrangements 36, thus bringing the jet manifolds, the mechanical cutters, side guide rollers and eductor system into their respective working positions shown in the drawings.

By preference, the guide rollers and the supports therefor are conventionally fitted with conventional load cells (not shown) which conventionally report to the control center at the surface the pipeline/sled interaction loads, so any tendency of the sled not to follow the route of the pipeline can be detected early and appropriate course correction measures taken.

As the sled is advanced along the pipeline, it may be continually monitored, e.g. by divers and/or remotely by electronic means. Some adjustments, such as operating the hydraulic piston and cylinder arrangements which have been described, may be accomplished by such divers and/or by remote control from the surface vessel.

The system 10 combines a jet sled, with a mechanical trencher, using the water jets at the front for fluidizing loose soil, and using the mechanical cutters toward the middle when encountering hard bottom, e.g. consolidated limestone rock. The material which is jetted loose or cut loose is then sucked-up and blown out of the way by the eductor located toward the rear of the sled. In composite conditions, where a hard bottom is covered by a layer of loose material to a depth that is shallower than the depth to which the pipeline must be trenched, a combination of jetting and cutting may be used. As the trench is created under the pipeline and the sled moves ahead, the pipeline behind the sled droops into the trench.

Assuming that operations are begun where the seabed is soft, after the pipeline has been cradled in the sets of cradle rollers 88 and elevated using the jacks 92, and the auxiliary frames closed about the pipeline to bring the mechanical cutters 78 into position below the elevated pipeline, the jet manifolds 48 into depending relation at the sides of the front of the tunnel 26, the eductor tubes 62 into depending relation at the sides of the rear of the tunnel 26 and the pipe guide rollers 84, 86 into rolling engagement with opposite sides of the pipeline, the piston/cylinder arrangement 60 is pressurized in a sense to project the jet manifolds 48 downwards, and pressurized water is pumped down through the supply line 54 and out the nozzles 59 as jets which loosen the soft seabed forwardly and downwardly over a width sufficient to create a broad enough trench for the pipeline, but insufficiently broad as to destroy bottom support for the pontoons. The surface vessel (not shown) is advanced along the pipeline path thus towing the sled 12 with its pontoons 14 acting as runners.

As the strip of soft seabed which has been fluidized by the jets passes relatively rearwardly, the pressurized air supplied to the eductor tubes 62 causes the fluidized material to be sucked up through the open lower ends 66 and foamed out of the open upper ends 70. Meanwhile, as the sled advances, the pipeline settles into the trench thus formed in the seabed. The profile of the trench as preferably formed in the soft seabed is indicated at S in FIG. 1. The angle of repose of the trench flanks in soft seabed is dependent on grain size and sharpness, but typically is thirty degrees.

Upon encountering hard seabed, the jet manifolds 48 can be raised so as to clear the hard surface, by operating the piston/cylinder arrangements 60 in a sense to sufficiently raise the jet manifolds 48. Trenching then continues using the mechanical cutters 78. The cutters 78 preferably are counter-rotated by the hydraulic motors 82 in a sense such that their peripheral surfaces turn towards one another as seen from the front. The cuttings are converged by screw action up between the cutters to the motors and spills over the top. The eductors 62 are operated, in the same way that they are operated when the trench is being formed solely by fluid jetting as has been described above, to remove the cut material from the trench and flume it into the sea, with the pipeline settling into the trench behind the apparatus 10 as the sled is towed along.

In the case of trenching in solid material, such as limestone seabeds, the profile of the trench preferably appears as shown at R in FIG. 1.

While the apparatus 10 is operating, the eductor tubes 62 may be raised and lowered using the piston and cylinder arrangement 64 in order to clear rock outcrops and also to ensure that the proper amount of loosened seabed material is being removed to create the trench. The suction action provided by the air issuing upward in the bases of the extension tubes 68 may additionally be modulated by increasing and decreasing air pressure, lengthening and shortening the extensions 68, and by taking similar measures.

Figure 9:
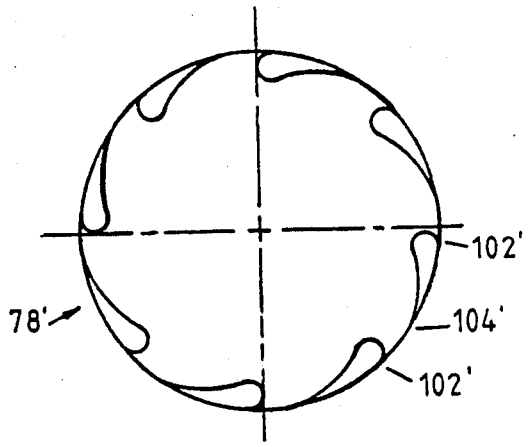
FIG. 9 is a horizontal transverse sectional view of that cutter taken on line 9—9 of FIG. 8.
Figure 8:
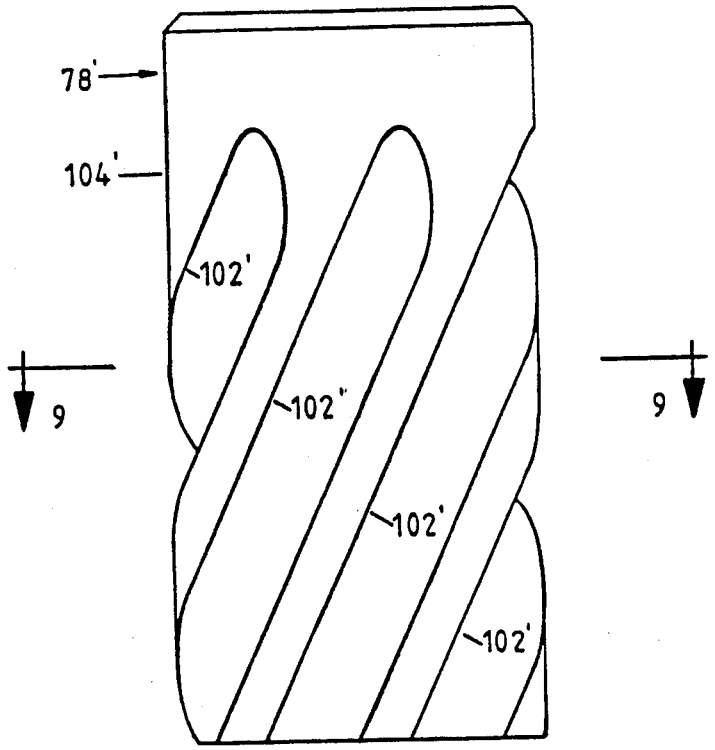
FIG. 8 is a further-enlarged scale side elevational view of one mechanical cutter useful thereof.
Figure 11:
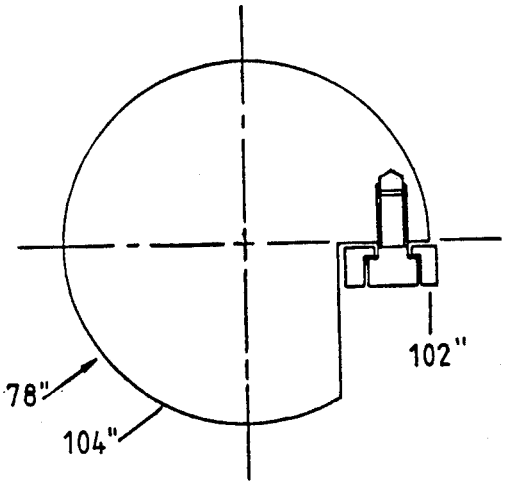
FIG. 11 is a horizontal transverse sectional view of that cutter taken on line 11—11 of FIG. 10.
Figure 10:
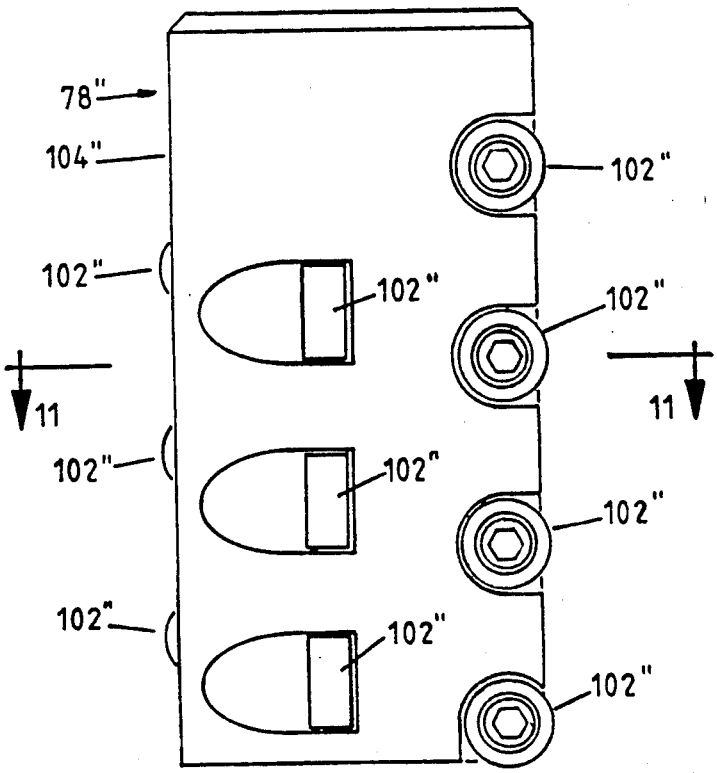
FIG. 10 is an enlarged scale side elevational view of another mechanical cutter useful on the subsea pipeline trenching machine of the invention.

Preferred designs for the mechanical cutters 78 are shown in FIGS. 8–11. In FIGS. 8 and 9, the cutter 78' is a cylinder integrally equipped with hardened steel blades 102' formed by spirally grooving the peripheral surface 104'. In FIGS. 10 and 11, the cutter 78'' is a cylinder equipped with tungsten carbide inserts 102'' bolted in notches formed in respective series of spirals in the peripheral surface 104''.

Some dimensions will now be given by an illustrative embodiment of the apparatus 10 in order to help those skilled in the art more readily to comprehend the principles of the invention.

In a typical apparatus 10 for trenching the seabed in shallow water, down to a depth of about 100 meters, pipeline having a maximum diameter of 460 mm can be trenched in a trench that is up to 1600 mm deep in sand and up to 550 mm deep and 920 mm wide in hard limestone. The minimum trenching speed is 4 meters per minute in sand and 2 meters per minute in limestone. The mechanical cutters may be powered by two 225 horsepower Hagglund hydraulic radial piston motors.

Further exemplary dimensions are as follows:

Jet Pump performance: 3000 GPM at 250 PSI

Spoil Removal: 2–254 mm Air lifts with 21 cubic M/min. Suction Volume each at 7 M/sec. Velocities Air Compressor Power: 1200 CFM at 90 PSI.

Hydraulic Pump Requirements: 3,500 PSI at 300 Gal/-min.

Sled Weight in Air: 7 tonnes

Dimensions: 10.5 M×5.6 M×2 M

By way of reiteration of points made earlier in this description, where the seabed is hard but has a top layer of soft material, the apparatus 10 may be operated simultaneously as a jet sled and as a mechanical cutter, simply by using both the jets and the cutters simultaneously, with the jets being raised and lowered, as necessary to clear the underlying hard surface. The piston and cylinder arrangements 60, 64 typically are operated by divers by actuating valves having actuators located on the sled. However, remote monitoring and operation is possible where bottom conditions do not become too turbid.

The apparatus 10 can be easily disassembled, transported and reassembled at a different site in order to maximize use of the apparatus.

The compressed air-powered eductor system as described can lift cobbles up to about 120 mm in diameter, and disperse removed soil 5–10 meters above the seabed in large flumes. For operation in depths greater than 60 meters, preferably the eductors are switched over to pressurized water power.

In excess of depths of 100 meters, preferably the apparatus 10 is modified to be self-powered, rather than towed, by mounting powered crawler tracks to the pontoons. In such a case, a surface vessel is relied upon for pumping, remote controlling, diver support and the like.

It should now be apparent that the Apparatus and Method for Trenching Subsea Pipelines as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. Apparatus for trenching a prelaid subsea pipeline of indeterminate length, comprising:

a sled including a frame and two laterally spaced pipeline- and trench-straddling supports constructed and arranged to run on the seabed and to define with said frame a tunnel extending longitudinally of the sled, such tunnel being open to the front and to the rear;

roller cradle means on said frame for supporting a segment of the pipeline in an elevated condition relative to the seabed, with the pipeline upstream and downstream of that segment sloping downwards to the seabed to the front of the sled and, to the rear of the sled, into a trench formed by the apparatus;

at least one vertically adjustable jet manifold mounted on said frame near the front of said tunnel, each said jet manifold being constructed and arranged to fluidize soft seabed in a region of the seabed which is sufficiently wide for trenching the pipeline, but which is insufficiently wide as to destroy support for said laterally spaced supports of said sled;

at least one vertically adjustable eductor tube mounted on said frame near the rear of said tunnel, each said eductor tube being constructed and arranged to suck-up loosened seabed material from said seabed region and remove such material sufficiently to trench the pipeline behind said apparatus;

a set of counter-rotating, vertical axis mechanical cutters mounted to said frame intermediate said at least one jet manifold and said at least one eductor tube and being movably mounted for movement to and from a working position located beneath said elevated segment of the pipeline;

means for advancing said sled along the pipeline;

means for supplying a pressurized working fluid to said at least one jet manifold for jetting into said seabed in said region;

motor means for powering said mechanical cutters in such a sense as to cut into said seabed in said region when said cutters are disposed in said working position; and means for supplying an upwardly-moving stream of pressurized fluid in said at least one eductor tube for sucking loosened seabed material from said region to create said trench.

2. The apparatus of claim 1, wherein:

said frame includes a plurality of left and right legs extending upwards from connection to respective left and right laterally spaced said supports, and a plurality of transverse and longitudinal members interconnected with said legs and one another; and further including left and right auxiliary frames hinged to said frame for movement between a depending, working position and a laterally outwardly, upwardly raised, stowed position;

said at least one jet manifold, said mechanical cutters and said at least one eductor tube being mounted to said auxiliary frames for movement therewith.

3. The apparatus of claim 2, wherein:

said laterally spaced supports are floodable pontoons, and said sled is constructed and arranged to be towed.

4. The apparatus of claim 2, wherein:

said at least one jet manifold comprises a left jet manifold mounted to said left auxiliary frame and a right jet manifold mounted to said right auxiliary frame; and said means for mounting said at least one jet manifold comprises respective pressurized fluid-operated extensible-retractable piston and cylinder arrangements mounted between respective said jet manifolds and respective said auxiliary frames.

5. The apparatus of claim 2, wherein:

said set of mechanical cutters comprises a left rotary cutter mounted to said left auxiliary frame and a right rotary cutter mounted to said right auxiliary frame; and said means for powering said mechanical cutters comprises respective pressurized fluid-operated motors constructed and arranged to counter-rotate said cutters.

6. The apparatus of claim 2, wherein:

said at least one eductor tube comprises a left eductor tube mounted to said left auxiliary frame and a right eductor tube mounted to said right auxiliary frame; and said eductor tube mounting means comprises respective pressurized fluid-operated extensible-retractable piston and cylinder arrangements mounted between respective said eductor tubes and respective said auxiliary frames.

7. The apparatus of claim 2, further comprising:

means mounted on said sled and connected with said auxiliary frames for moving said auxiliary frames between said stowed and working positions thereof.

* * * * *